US005656577A

United States Patent [19]

Kato et al.

[11] Patent Number: 5,656,577

[45] Date of Patent: Aug. 12, 1997

[54] FLUID COMPOSITION FOR FLUID COUPLING

[75] Inventors: Tomohiro Kato; Hitoshi Ohenoki; Hironari Ueda; Mikiro Arai; Toshiaki Kuribayashi, all of Saitama-ken, Japan

[73] Assignee: Tonen Corporation, Tokyo, Japan

[21] Appl. No.: 283,864

[22] Filed: Aug. 1, 1994

[30] Foreign Application Priority Data

Jul. 30, 1993 [JP] Japan ..... 5-189903

[51] Int. Cl.[6] ..... C10M 105/70; C10M 105/74; C10M 105/76

[52] U.S. Cl. ..... 508/210; 252/78.1; 252/78.3; 252/78.5

[58] Field of Search ..... 252/49.8, 47, 47.5, 252/78.1, 78.3, 78.5; 508/210

[56] References Cited

U.S. PATENT DOCUMENTS

| | | | |
|---|---|---|---|
| 3,609,079 | 9/1971 | Devine | 252/46.3 |
| 3,977,986 | 8/1976 | Conte, Jr. et al. | 252/78.3 |
| 5,151,204 | 9/1992 | Struglinski | 252/52 R |
| 5,332,515 | 7/1994 | Tomizawa et al. | 252/49.6 |
| 5,366,646 | 11/1994 | Sato et al. | 252/49.8 |

FOREIGN PATENT DOCUMENTS

| | | |
|---|---|---|
| 397 507 A1 | 5/1990 | European Pat. Off. . |
| 462 777 A2 | 6/1991 | European Pat. Off. . |
| 456 156 A2 | 6/1991 | European Pat. Off. . |
| 2 206 887 | 1/1989 | United Kingdom . |

*Primary Examiner*—Paul Lieberman
*Assistant Examiner*—Gregory R. Delcotto
*Attorney, Agent, or Firm*—Lowe, Price, LeBlanc & Becker

[57] ABSTRACT

The invention provides a fluid composition for a fluid coupling, which is excellent in viscosity stability and torque stability, and comprises a polyorganosiloxane base oil having a viscosity of 3,000–500,000 $mm^2$/sec at 25° C. and at least one 5-membered heterocyclic compound incorporated in a proportion of 0.01–3.0 wt. % based on the total weight of the composition, said 5-membered heterocyclic compound being selected from the group consisting of thiadiazole derivatives and thiazole derivatives, both, having at least one monovalent group represented by the formula $—S_x—R^6$ in which $R^6$ is a saturated or unsaturated monovalent group or atom composed of at least one atom selected from a carbon atom, a hydrogen atom, an oxygen atom, a nitrogen atom and a sulfur atom, and x is a number of 1 or greater.

12 Claims, No Drawings

FLUID COMPOSITION FOR FLUID COUPLING

FIELD OF THE INVENTION

The present invention relates to a fluid composition used for power transmission in a fluid coupling, and more particularly to a fluid composition for a fluid coupling, which is excellent in viscosity stability and torque stability. The fluid composition according to the present invention is particularly suitable for use as a viscous fluid for a viscous coupling.

BACKGROUND OF THE INVENTION

A device in which mechanical power is converted to fluid power, and the fluid power is returned to the mechanical power to perform power transmission is called a hydraulic power transmission. A fluid coupling is a kind of hydraulic power transmission. Examples of the fluid coupling include those having various structures and actions. A viscous coupling is used in a power transmission device for a differential limiting-device for automobile, a differential gear for four-wheel drive car or a cooling fan for an automobile engine, or the like.

The viscous coupling is a device in which disks (plates) or cylinders separately connected to input and output shafts are arranged in such a manner that gaps therebetween are sufficiently narrow, and power is transmitted by shearing force based on the viscosity of a fluid in the gaps.

The viscous coupling is a sort of liquid clutch, which permits smooth slide. A typical specific structure thereof is constructed in such a manner that plural inner plates arranged movably on the side of a drive shaft (input shaft) and plural outer plates fixed on the side of a driven shaft (output shaft) are alternately combined with each other, and individual gaps between the alternately combined plates are held at regular intervals by spacers such as separate rings. These plates are contained in a housing in which a viscous fluid for transmitting torque is filled. The viscous fluid is filled in the spaces between the plural plates.

The viscous coupling servers to generate viscous torque in the spaces between the plates when a difference in revolution speed between the drive shaft and the driven shaft arises, and torque is transmitted on the side of the driven shaft in proportion to the viscous torque generated owing to the difference in revolution speed.

As the viscous fluid, silicone oil is generally used. Specifically, polyorganosiloxanes such as dimethyl polysiloxane (i.e., dimethyl silicone oil) and methylphenyl polysiloxane (i.e., methylphenyl silicone oil) are used as the silicone oil. These polyorganosiloxanes are good in heat resistance and oxidation resistance compared with other base oils and moreover in temperature-viscosity characteristics over a wide range and have a high viscosity index (VI).

However, since the temperature of the oil is raised to about 100°–180° C. according to the service conditions of the viscous coupling, or to such a high temperature as exceeding 200° C. under severe conditions, for example, such as repeated hump-stack, the stability of the polyorganosiloxane is lowered, and so abnormal wear of the plates and gelation of the polyorganosiloxane occur. The gelation of the polyorganosiloxane is considered to increases its viscosity because a polymerization reaction occurs on the polymer. Accordingly, its viscosity stability is also impaired in association with the gelation.

As described above, the polyorganosiloxanes are low in stability at a high temperature and are hence difficult to stably keep the torque-transmitting performance over a long period of time under severe service conditions. As a countermeasure, it has heretofore been proposed to incorporate various additives such as an antioxidant and an extreme-pressure additive.

For example, Japanese Patent Application Laid-Open No. 65195/1989 has proposed a fluid composition for a viscous coupling in which a specific sulfur compound or a metal salt of dialkyldithiocarbamic acid is incorporated into a polyorganosiloxane. Japanese patent Application Laid-Open No. 91196/1990 has proposed a fluid composition for a viscous coupling in which a specific phosphorus compound is incorporated into a polyorganosiloxane. Japanese patent Application Laid-Open No. 269093/1991 has proposed a fluid composition for a viscous coupling in which a metal deactivator is incorporated in a proportion of 0.01–1.0 wt. % into a polyorganosiloxane. In Japanese patent Application Laid-Open No. 50296/1992, it has been proposed to add a metal deactivator and/or a corrosion inhibitor to a polyorganosiloxane.

However, these conventional compositions have not been yet fully satisfactory in anti-gelling performance, viscosity stability and torque stability.

OBJECTS AND SUMMARY OF THE INVENTION

It is an object of the present invention to provide a fluid composition for a fluid coupling, which is excellent in anti-gelling performance for a polyorganosiloxane base oil, undergoes little change in viscosity and torque and has good stability and extremely high durability.

It is a more specific object of the present invention to provide a fluid composition for a fluid coupling, which is excellent in viscosity stability and torque stability, and is particularly suitable for a viscous fluid for a viscous coupling.

The present inventors have carried out an extensive investigation with a view toward overcoming the above-described problems involved in the prior art. As a result, it has been found that when a 5-membered heterocyclic compound, more specifically, a thiadiazole derivative and/or a thiazole derivative is caused to contained in a polyorganosiloxane base oil, a fluid composition which has excellent anti-gelling performance for the polyorganosiloxane base oil and undergoes little change in viscosity and torque even under high temperature conditions can be obtained.

It has also been found that when these 5-membered heterocyclic compounds are combined with various additives, a fluid composition more improved in oxidative stability, viscosity stability, torque stability or compatibility with rubbers can be obtained.

Accordingly, when the fluid composition according to the present invention is used as a viscous fluid in a viscous coupling or the like, it exhibits excellent performance even under severe conditions, and moreover permits the achievement of good long-term durability of the viscous coupling itself.

The present invention has been led to completion on the basis of these findings.

According to the present invention, there is thus provided a fluid composition for a fluid coupling, comprising a polyorganosiloxane base oil having a viscosity of 3,000–500,000 $mm^2$/sec at 25° C. and at least one 5-membered heterocyclic compound incorporated in a proportion of 0.01–3.0 wt. % based on the total weight of the composition into the base oil, said 5-membered heterocyclic compound being selected from the group consisting of compounds represented by the following general formulae (I)–(V):

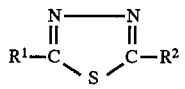
(I)

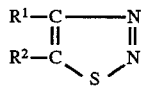
(II)

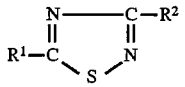
(III)

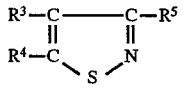
(IV)

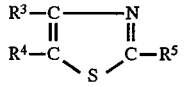
(V)

wherein $R^1$–$R^5$ are, independently of each other, a saturated or unsaturated monovalent group or atom composed of at least one atom selected from a carbon atom, a hydrogen atom, an oxygen atom, a nitrogen atom and a sulfur atom, with the proviso that at least one of $R^1$ and $R^2$, and at least one of $R^3$–$R^5$ are individually a monovalent group represented by the formula $—S_x—R^6$ in which $R^6$ is a saturated or unsaturated monovalent group or atom composed of at least one atom selected from a carbon atom, a hydrogen atom, an oxygen atom, a nitrogen atom and a sulfur atom, and x is a number of 1 or greater.

DETAILED DESCRIPTION OF THE INVENTION

Features of the present invention will hereinafter be described in detail.

Base oil:

The base oil useful in the practice of the present invention is a polyorganosiloxane (i.e., silicone oil) having a viscosity of 3,000–500,000 $mm^2$/sec (cSt) as measured at 25° C. The viscosity is preferably 5,000–500,000 $mm^2$/sec. The representative of such a polysiloxane is a polymer represented by the following general formula:

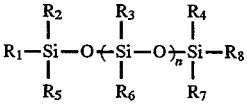

In the formula, $R_1$–$R_8$ may be identical with or different from each other and mean individually a hydrocarbon group having 1–18 carbon atoms. These hydrocarbon groups may be optionally substituted by at least one halogen atom. n stands for an integer of 1–3,000, preferably 400–1,500.

Specific examples of $R_1$–$R_8$ include alkyl groups such as methyl, ethyl, n-propyl, isopropyl, n-butyl, isobutyl, t-butyl, n-pentyl, neopentyl, hexyl, heptyl, octyl, decyl and octadecyl groups; aryl groups such as phenyl and naphthyl groups; aralkyl groups such as benzyl, 1-phenylethyl and 2-phenylethyl groups; araryl groups such as o-, m- and p-diphenyl groups; and halogenated hydrocarbon groups such as o-, m- and p-chlorophenyl, o-, m- and p-bromophenyl, 3,3,3-trifluoropropyl, 1,1,1,3,3,3-hexafluoro-2-propyl, heptafluoroisopropyl and heptafluoro-n-propyl groups.

Fluorinated hydrocarbon groups having 1–8 carbon atoms, exclusive of aliphatic unsaturated groups, methyl group and phenyl group are particularly preferred as $R_1$–$R_8$. A mixture of methylpolysiloxane and phenylpolysiloxane may be use as a base oil.

Preferable examples of the polyorganosiloxanes used in the present invention include dimethyl silicone oil, methylphenyl silicone oil, methyl hydrogensilicone oil and fluorosilicone oil.

If the viscosity of the base oil is lower than 3,000 $mm^2$/sec, sufficient torque can not be provided when using the resulting composition as a fluid for a viscous coupling. If the viscosity of the base oil is excessively high on the contrary, torque may rapidly rise during use of the resulting composition.

Five-membered heterocyclic compound:

In the present invention, at least one 5-membered heterocyclic compound selected from the group consisting of compounds represented by the general formulae (I)–(V) is incorporated in a proportion of 0.01–3.0 wt. % based on the total weight of the composition into the polyorganosiloxane base oil.

The compounds represented by the general formulae (I)–(III) are thiadiazole derivatives. The thiadiazole derivatives are compounds in which $R^1$ and $R^2$ in the general formulae (I)–(III) are, independently of each other, a saturated or unsaturated monovalent group or atom composed of at least one atom selected from a carbon atom, a hydrogen atom, an oxygen atom, a nitrogen atom and a sulfur atom.

However, at least one of $R^1$ and $R^2$ in the general formulae (I)–(III) is a monovalent group represented by the formula $—S_x—R^6$ in which $R^6$ is a saturated or unsaturated monovalent group or atom composed of at least one atom selected from a carbon atom, a hydrogen atom, an oxygen atom, a nitrogen atom and a sulfur atom, and x stands for a number of 1 or greater. x is preferably 1–3. Examples of $R^6$ may include alkyl groups such as methyl, ethyl, propyl and octyl groups; substituted alkyl groups such as 2-phenylethyl and 2-phenylpropyl groups; alkenyl groups such as vinyl and propenyl groups; aryl groups such as phenyl, tolyl, xylyl and naphthyl groups; and aralkyl groups such as benzyl and phenethyl. These groups may further include a carboxyl group, ester, alcohol, amino group or the like.

Besides $—S_x—R^6$, examples of $R^1$ and $R^2$ may include alkyl groups such as methyl, ethyl, propyl and octyl groups; substituted alkyl groups such as 2-phenylethyl and 2-phenylpropyl groups; alkenyl groups such as vinyl and propenyl groups; aryl groups such as phenyl, tolyl, xylyl and naphthyl groups; and aralkyl groups such as benzyl and phenethyl. These groups may further include a carboxyl group, ester, alcohol, amino group or the like.

Specific examples of the thiadiazole derivatives represented by the general formulae (I)–(III) include 2,5-dimercapto-1,3,4-thiadiazole, 2-mercapto-5-methylmercapto-1,3,4-thiadiazole, di(5-mercapto-1,3,4-thiadiazol-2-yl)disulfide, 2,5-bis(n-octyldithio)-1,3,4-thiadiazole, 2-amino-5-mercapto-1,3,4-thiadiazole, derivatives of these compounds (for example, alkyl derivatives in which the mercapto group has been alkylated), and mixtures of at least two compounds thereof. Of these, 2,5-dimercapto-1,3,4-thiadiazole derivatives such as 2,5-dioctylmercapto-1,3,4-thiadiazole are particularly preferred because they are easily available and excellent in operational effect.

On the other hand, the compounds represented by the general formulae (IV) and (V) are thiazole derivatives. The thiazole derivatives are compounds in which $R^3$–$R^5$ in the general formulae (IV)–(V) are, independently of each other, a saturated or unsaturated monovalent group or atom composed of at least one atom selected from a carbon atom, a hydrogen atom, an oxygen atom, a nitrogen atom and a sulfur atom.

However, at least one of $R^3$–$R^5$ in the general formulae (IV)–(V) is a monovalent group represented by the formula $—S_x—R^6$ in which $R^6$ is a saturated or unsaturated monovalent group or atom composed of at least one atom selected from a carbon atom, a hydrogen atom, an oxygen atom, a nitrogen atom and a sulfur atom, and x stands for a number of 1 or greater. x is preferably 1–3. Examples of $R^6$ may include alkyl groups such as methyl, ethyl, propyl and octyl groups; substituted alkyl groups such as 2-phenylethyl and 2-phenylpropyl groups; alkenyl groups such as vinyl and propenyl groups; aryl groups such as phenyl, tolyl, xylyl and naphthyl groups; and aralkyl groups such as benzyl and phenethyl. These groups may further include a carboxyl group, ester, alcohol, amino group or the like.

Besides $—S_x—R^6$, examples of $R^3$–$R^5$ may include alkyl groups such as methyl, ethyl, propyl and octyl groups; substituted alkyl groups such as 2-phenylethyl and 2-phenylpropyl groups; alkenyl groups such as vinyl and propenyl groups; aryl groups such as phenyl, tolyl, xylyl and naphthyl groups; and aralkyl groups such as benzyl and phenethyl. These groups may further include a carboxyl group, ester, alcohol, amino group or the like.

Specific examples of the thiazole derivatives or represented by the general formulae (IV) and (V) include 2-mercapto-4-methyl-5-(2'-hydroxyethyl)thiazole, 2-mercaptobenzothiazole, and derivatives of these compounds (for example, alkyl derivatives in which the mercapto group has been alkylated).

When at least one of the above-described specific 5-membered heterocyclic compounds is incorporated into the polyorganosiloxane base oil, a fluid composition in which the gelation of the polyorganosiloxane is suppressed and the base oil undergoes little change in viscosity and torque even under high temperature conditions, can be obtained.

The 5-membered heterocyclic compound is used in a proportion of 0.01–3.0 wt. %, preferably 0.1–2.0 wt. % based on the total weight of the composition. If the proportion of this compound is lower than 0.01 wt. %, a fluid composition sufficient in viscosity stability and torque stability can not be provided. If the proportion exceeds 3.0 wt. %, the stabilizing effects on changes in viscosity and torque become saturated, and the resulting composition offers problems of solubility in the base oil and compatibility with rubber used in sealing parts and the like in some instances.

Other additives:

In addition to the 5-membered heterocyclic compound as an essential component, various kinds of additives such as antioxidants, wear preventives, corrosion inhibitors and metal deactivators may be incorporated into the fluid composition according to the present invention. Among these various additives, there are additives markedly exhibiting synergistic effects as to the improvement of viscosity stability, torque stability, anti-gelling property for the base oil, heat stability and the like when they are used in combination with the 5-membered heterocyclic compound.

Examples of such various additives include the following compounds:

1. As the corrosion inhibitor, may be added, for example, isostearates, n-octadecylammonium stearate, Duomeen T diolate, lead naphthenate, sorbitan oleate, pentaerythritol oleate, oleyl sarcosine, alkylsuccinic acids, alkenylsuccinic acids, and derivatives thereof. The amount of these corrosion inhibitors to be added is generally 0.01–1.0 wt. %, preferably 0.01–0.5 wt. % based on the total weight of the composition. If the amount of the corrosion inhibitor to be added is less than 0.01 wt. %, the effect of the inhibitor added is insufficient. If the amount exceeding 1.0 wt. % on the contrary, precipitate greatly occurs in the composition.

2. As the wear preventive, may be incorporated bisphosphoric ester compounds, bisthiophosphoric ester compounds or bisdithiophosphoric ester compounds, which are represented by the following general formulae (VI)–(IX):

Compounds represented by the general formula (VI):

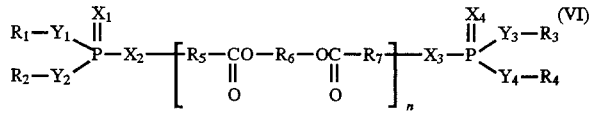

(VI)

In the general formula (VI), $R_1$–$R_4$ are, independently of each other, a hydrogen atom or a monovalent hydrocarbon group having 1–20 carbon atoms. Examples of the hydrocarbon group include linear or branched alkyl groups, aryl groups, aralkyl groups and araryl groups. These groups may also include halogenated hydrocarbon groups. $R_5$–$R_7$ are, independently of each other, a divelent hydrocarbon group having 1–6 carbon atoms. Specific examples thereof include alkylene groups, arylene groups and halogenated hydrocarbon groups. $X_1$–$X_4$ and $Y_1$–$Y_4$ are, independently of each other, an oxygen or sulfur atom. However, $R_1$–$R_4$ may directly bond to the respective phosphorus atoms through no $Y_1$–$Y_4$. n stands for an integer of 0–2, with the proviso that both $X_2$ and $X_3$ mean a sulfur atom if n is 0.

Examples of the alkyl groups include methyl, ethyl, n-propyl, isopropyl, n-butyl, isobutyl, t-butyl, n-pentyl, neopentyl, hexyl, heptyl, octyl, decyl and octadecyl groups. Examples of the aryl groups include phenyl and naphthyl groups. Examples of the aralkyl groups include benzyl, 1-phenylethyl and 2-phenylethyl groups. Examples of the araryl groups include o-, m- and p-diphenyl groups. Examples of the halogenated hydrocarbon groups include o-, m- and p-chlorophenyl, o-, m- and p-bromophenyl, 3,3,3-trifluoropropyl and 1,1,1,3,3,3-hexafluoro-2-propyl groups. (Incidentally, the above-mentioned specific examples of these groups shall apply to those of the following various additive compounds.)

Of the compounds represented by the general formula (VI), those in which $R_1$–$R_4$ are individually a hydrocarbon group having 1–10 carbon atoms are particularly preferred from the viewpoint of adsorptiveness on a metal surface and solubility in the polyorganosiloxane base oil. Compounds in which $R_1$–$R_4$ are individually a phenyl or alkylphenyl group are preferred from the viewpoint of heat resistance.

Compounds in which $X_1$–$X_4$ in the general formula (VI) are all oxygen atoms are bisphosphoric esters. Compounds in which one, two or three of $X_1$–$X_4$ in the general formula (VI) are oxygen atoms, and the remainder is a sulfur atom are bisthiophosphoric esters. Compounds in which $X_1$–$X_4$ in the general formula (VI) are all sulfur atoms are bisdithiophosphoric esters.

Compounds represented by the general formula (VII):

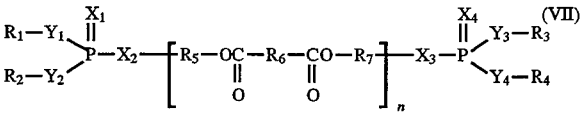

(VII)

In the general formula (VII), $R_1$–$R_7$, $X_1$–$X_4$, $Y_1$–$Y_4$ and n have the same meaning as defined above in the general formula (VI).

Compounds represented by the general formula (VIII):

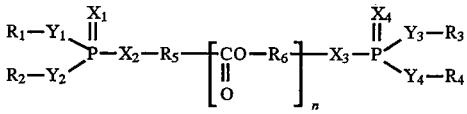

(VIII)

In the general formula (VIII), $R_1$–$R_4$ are, independently of each other, a hydrogen atom or a monovalent hydrocarbon group having 1–20 carbon atoms. Examples of the hydrocarbon group include linear or branched alkyl groups, aryl groups, aralkyl groups and araryl groups. These groups may also include halogenated hydrocarbon groups. $R_5$ and $R_6$ are, independently of each other, a divalent hydrocarbon group having 1–6 carbon atoms. Specific examples thereof include alkylene groups, arylene groups and halogenated hydrocarbon groups. $X_1$–$X_4$ and $Y_1$–$Y_4$ are, independently of each other, an oxygen or sulfur atom. However, $R_1$–$R_4$ may directly bond to the respective phosphorus atoms through no $Y_1$–$Y_4$. n stands for an integer of 0–2. Of the compounds represented by the general formula (VIII), those in which $R_1$–$R_4$ are individually a hydrocarbon group having 1–10 carbon atoms are particularly preferred from the viewpoint of adsorptiveness on a metal surface and solubility in the polyorganosiloxane base oil. Compounds in which $R_1$–$R_4$ are individually a phenyl or alkylphenyl group are preferred from the viewpoint of heat resistance.

Compounds represented by the general formula (IX):

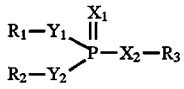

(IX)

In the general formula (IX), $R_1$ and $R_2$ are, independently of each other, a hydrogen atom or a monovalent hydrocarbon group having 1–20 carbon atoms. Examples of the hydrocarbon group include linear or branched alkyl groups, aryl groups, aralkyl groups and araryl groups. These groups may also include halogenated hydrocarbon groups. $R_3$ is a hydrocarbon group having 1–20 carbon atoms and at least one ester bond. $X_1$ and $X_2$, and $Y_1$ and $Y_2$ are, independently of each other, an oxygen or sulfur atom. Of the compounds represented by the general formula (IX), those in which $R_1$ and $R_2$ are individually a phenyl or alkylphenyl group are preferred from the viewpoint of heat resistance.

The amount of the compounds represented by the general formulae (VI)–(IX) to be added is generally 0.01–5.0 wt. %, preferably 0.1–3.0 wt. % based on the total weight of the composition.

When the compounds represented by the general formulae (VI)–(IX) are used in combination with the 5-membered heterocyclic compound, the viscosity stability and torque stability of the polyorganosiloxane base oil can be more enhanced. Of these compounds, compounds represented by the general formula (IX), among others, thiophosphoric esters are particularly preferred.

3. As a phosphorus-containing wear preventive, may be incorporated compounds represented by the following general formulae (X)–(XIII).

Compounds represented by the general formula (X):

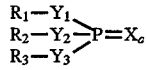

(X)

In the general formula (X), $R_1$–$R_3$ are, independently of each other, selected from a hydrogen atom and hydrocarbon groups having 1–20 carbon atoms, with the proviso that at least one of these is a hydrocarbon group. Therefore, compounds in which $R_1$–$R_3$ are all hydrogen atoms are omitted. The hydrocarbon group is preferably a linear or branched alkyl group, aryl group, aralkyl group or araryl group. Halogenated groups thereof may also be included. X, and $Y_1$–$Y_3$ are, independently of each other, an oxygen or sulfur atom. a is 0 or 1.

As the compounds represented by the general formula (X), may be mentioned compounds represented by the following general formulae (1)–(6):

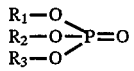

(1)

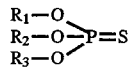

(2)

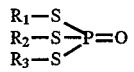

(3)

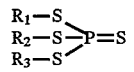

(4)

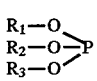

(5)

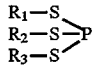

(6)

Examples of the compounds represented by the general formula (1) include triaryl phosphates and the like. Specific examples thereof include phosphoric esters such as benzyldiphenyl phosphate, allyldiphenyl phosphate, triphenyl phosphate, tricresyl phosphate, ethyldiphenyl phosphate, tributyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutylphenylphenyl phosphate, tributylphenyl phosphate, propylphenylphenyl phosphate mixtures and butylphenylphenyl phosphate mixtures; and acid phosphoric esters such as acid lauryl phosphate, acid stearyl phosphate and di-2-ethylhexyl hydrogenphosphate.

As examples of the compounds represented by the general formula (2), may be mentioned compounds in which phosphates in the specific examples of the compounds represented by the general formula (1) are replaced by thiophosphates.

Examples of the compounds represented by the general formula (3) include triaryl phosphorothionates and alkyldiaryl phosphorothionates. Specific examples thereof include triphenyl phosphorothionate.

As examples of the compounds represented by the general formula (4), may be mentioned compounds in which phosphorothionates in the specific examples of the compounds represented by the general formula (3) are replaced by thiophosphorothionates.

As examples of the compounds represented by the general formula (5), may be mentioned phosphorous esters such as triisopropyl phosphite, triphenyl phosphite, tricresyl phosphite, tris(nonylphenyl) phosphite, triisooctyl phosphite, diphenylisodecyl phosphite, phenyldiisodecyl phosphite, triisodecyl phosphite, trisstearyl phosphite and trioleyl phosphite; and acid phosphorous esters such as diisopropyl hydrogenphosphite, di-2-ethylhexyl hydrogenphosphite, dilauryl hydrogenphosphite and dioleyl hydrogenphosphite.

As examples of the compounds represented by the general formula (6), may be mentioned compounds, such as thiolauryl thiophosphite, in which phosphites in the specific examples of the compounds represented by the general formula (5) are replaced by thiophosphites.

These phosphorus compounds generally act as wear preventives. However, they serve to more enhance the operational effects as to the improvement of viscosity stability, torque stability, anti-gelling property for the polyorganosiloxane base oil when they are used in combination with the 5-membered heterocyclic compounds such as thiadiazole derivatives and thiazole derivatives.

Of these phosphorus compounds, compounds having a structure of triaryl phosphate or triaryl phosphorothionate are particularly preferred from the viewpoint of heat stability.

Compounds represented by the general formula (XI):

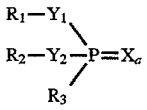

(XI)

In the general formula (XI), $R_1$–$R_3$ are, independently of each other, selected from a hydrogen atom and hydrocarbon groups having 1–20 carbon atoms, with the proviso that at least one of these is a hydrocarbon group. Therefore, compounds in which $R_1$–$R_3$ are all hydrogen atoms are omitted. The hydrocarbon group is preferably a linear or branched alkyl group, aryl group, aralkyl group or araryl group. Halogenated groups thereof may also be included. X, and $Y_1$ and $Y_2$ are, independently of each other, an oxygen or sulfur atom. a is 0 or 1.

As the compounds represented by the general formula (XI), may be mentioned compounds represented by the following general formulae (7)–(12):

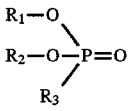

(7)

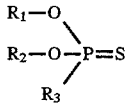

(8)

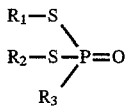

(9)

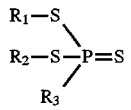

(10)

-continued

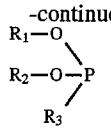

(11)

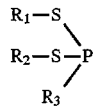

(12)

As specific examples of these phosphorus compounds, may be mentioned di-n-butylhexyl phosphonate represented by the formula (7).

Compounds represented by the general formula (XII):

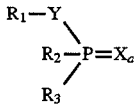

(XII)

In the general formula (XII), $R_1$–$R_3$ are, independently of each other, selected from a hydrogen atom and hydrocarbon groups having 1–20 carbon atoms, with the proviso that at least one of these is a hydrocarbon group. Therefore, compounds in which $R_1$–$R_3$ are all hydrogen atoms are omitted. The hydrocarbon group is preferably a linear or branched alkyl group, aryl group, aralkyl group or araryl group. Halogenated groups thereof may also be included. X and Y are, independently of each other, an oxygen or sulfur atom. a is 0 or 1.

As the compounds represented by the general formula (XII), may be mentioned compounds represented by the following general formulae (13)–(18):

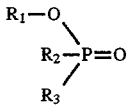

(13)

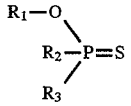

(14)

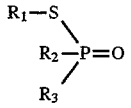

(15)

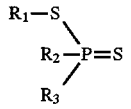

(16)

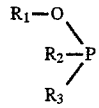

(17)

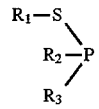

(18)

As specific examples of these phosphorus compounds, may be mentioned di-n-butyl-n-dioctyl phosphonate represented by the formula (13).

Compounds represented by the general formula (XIII):

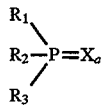

(XIII)

In the general formula (XIII), $R_1$–$R_3$ are, independently of each other, selected from a hydrogen atom and hydrocarbon groups having 1–20 carbon atoms, with the proviso that at least one of these is a hydrocarbon group. Therefore, compounds in which $R_1$–$R_3$ are all hydrogen atoms are omitted. The hydrocarbon group is preferably a linear or branched alkyl group, aryl group, aralkyl group or araryl group. Halogenated groups thereof may also be included. X is an oxygen or sulfur atom. a is 0 or 1.

As the compounds represented by the general formula (XIII), may be mentioned compounds represented by the following general formulae (19)–(21):

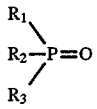

(19)

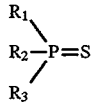

(20)

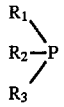

(21)

The proportion of these phosphorus compounds to be incorporated is generally 0.01–5.0 wt. %, preferably 0.1–3.0 wt. %, more preferably 0.1–1.0 wt. % based on the total weight of the composition.

4. As other wear preventives, may be added further phosphorus compounds represented by the following general formulae (22)–(27):

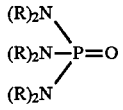

(22)

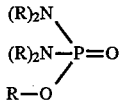

(23)

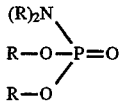

(24)

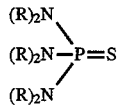

(25)

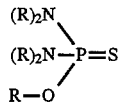

(26)

-continued

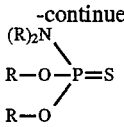

(27)

In these formulae, R is selected from a hydrogen atom and hydrocarbon groups having 1–20 carbon atoms. The hydrocarbon group is preferably a linear or branched alkyl group, aryl group, aralkyl group or araryl group. Halogenated groups thereof may also be included.

As specific examples of these compounds, may be mentioned hexamethylphosphoric triamide represented by the formula (22) and dibutylphosphoroamidate represented by the formula (23).

The proportion of these compounds to be incorporated is generally 0.01–5.0 wt. %, preferably 0.1–3.0 wt. %, more preferably 0.1–1.0 wt. % based on the total weight of the composition.

5. As a sulfur-containing wear preventive, may be added, for example, sulfides such as diphenyl sulfide, diphenyl disulfide, di-n-butyl sulfide, di-n-butyl disulfide, di-t-dodecyl disulfide and di-t-dodecyl trisulfide; sulfurized oils and fats such as sulfurized palm oil and sulfurized dipentene; thiocarbonates such as xanthic disulfide; and zinc thiophosphates such as zinc primary-alkyl-thiophosphates, zinc secondary-alkyl-thiophosphates, zinc alkylarylthiophosphates and zinc allylthiophosphates.

The proportion of these compounds to be incorporated is generally 0.01–5.0 wt. %, preferably 0.1–3.0 wt. % based on the total weight of the composition.

6. As a further wear preventive, may be added carbamate compounds represented by the following general formulae (XIV) and (XV).

Compounds represented by the general formula (XIV):

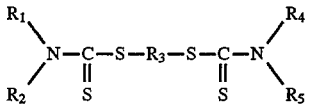

(XIV)

In the general formula (XIV), $R_1$, $R_2$, $R_4$ and $R_5$ are, independently of each other, selected from a hydrogen atom and hydrocarbon groups having 1–20 carbon atoms. The hydrocarbon group is preferably a linear or branched alkyl group, aryl group, aralkyl group or araryl group. Halogenated groups thereof may also be included. $R_3$ is a divalent hydrocarbon group (for example, an alkylene or phenylene group) having 1–6 carbon atoms, or a metal atom.

Compounds represented by the general formula (XV):

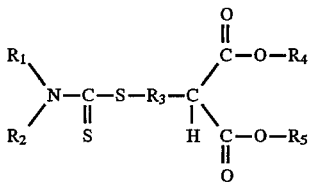

(XV)

In the general formula (XV), $R_1$, $R_2$, $R_4$ and $R_5$ are, independently of each other, selected from a hydrogen atom and hydrocarbon groups having 1–20 carbon atoms. The hydrocarbon group is preferably a linear or branched alkyl group, aryl group, aralkyl group or araryl group. Halogenated groups thereof may also be included. $R_3$ is a divalent hydrocarbon group (for example, an alkylene or phenylene group) having 1–6 carbon atoms, or a metal atom.

In the general formulae (XIV) and (XV), alkyl groups having 1–8 carbon atoms are preferred as the hydrocarbon groups, with alkyl groups having 3 or 4 carbon atoms being particularly preferred. As the divalent hydrocarbon groups, may be mentioned linear or branched alkylene groups, arylene groups and halogenated hydrocarbon groups. Of these, alkyl groups are preferred, with a methylene group being particularly preferred. As the metal atom, zinc is preferred. Incidentally, it is more effective that $R_3$ is not a metal atom, but a divalent hydrocarbon group.

When these carbamate compounds are used in combination with the 5-membered heterocyclic compound, the viscosity stability and torque stability of the resulting fluid composition are still more enhanced. Of these compounds, compounds represented by the general formula (XIV), for example, methylenebis-(dibutyldithiocarbamate), are particularly preferred.

The proportion of these compounds to be incorporated is generally 0.01–5.0 wt. %, preferably 0.1–3.0 wt. % based on the total weight of the composition.

7. It is preferable that the fluid composition according to the present invention should contain an antioxidant for the purpose of keeping the stability even if used under severe conditions such as high temperature conditions.

Examples of the antioxidant include amine compounds such as dioctyldiphenylamine, phenyl-α-naphthylamine, alkyldiphenylamines, N-nitrosodiphenylamine, phenothiazine, N,N'-dinaphthyl-p-phenylenediamine, acridine, N-methylphenothiazine, N-ethylphenothiazine, dipyridylamine, diphenylamine, phenolamine and 2,6-di-t-butyl-α-dimethylaminoparacresol; phenolic compounds such as 2,6-di-t-butylparacresol, 4,4'-methylenebis(2,6-di-t-butylphenol) and 2,6-di-t-butylphenol; organic metal compounds, for example, organic iron salts such as iron octoate, ferrocene and iron naphthoate, organic cerium salts such as cerium naphthoate and cerium toluate, and organic zirconium salts such as zirconium octoate; and mixtures of two or more compounds thereof.

When the antioxidant is used in combination with the 5-membered heterocyclic compound, the viscosity stability and torque stability of the resulting fluid composition are still more enhanced. Of these antioxidants, amine type antioxidants are particularly preferred.

The antioxidant is used in a proportion of generally 0.01–2.0 wt. %, preferably 0.05-1.0 wt. % based on the total weight of the composition. If the proportion of the antioxidant to be incorporated is too small, the effect of the antioxidant added is not very exhibited. On the contrary, proportions too great are not economical and involve a potential problem that the physical properties of the resulting composition may be lowered.

The above-described various additives may be added either singly or in any combination thereof to the polyorganosiloxane base oil, whereby the viscosity stability and torque stability of the composition can be more improved compared with the case where the 5-membered heterocyclic compound is added by itself. When these various additives are used in combination with the 5-membered heterocyclic compound, changes in viscosity and torque of the resulting fluid composition can be more lessened, and anti-gelling property for the polyorganosiloxane base oil can be more improved, in particular, under service conditions of a high temperature.

As the additives particularly high in effect when used in combination, may be mentioned (1) the compounds represented by the general formula (IX), among others, thiophosphoric ester compounds, (2) the compounds having a structure of triaryl phosphate or triaryl phosphorothionate, (3) the dithiocarbamate compounds represented by the general formula (XIV), and (4) the antioxidants, among others, amine type antioxidants.

ADVANTAGES OF THE INVENTION

According to the present invention, the addition of the 5-membered heterocyclic compound having the specific structure to the polyorganosiloxane base oil provides a fluid composition in which anti-gelling performance for the base oil, and its viscosity stability and torque stability are improved. When the specific 5-membered heterocyclic compound is used in combination with the antioxidants, various wear preventives and the like, a synergistic effect that the viscosity stability and torque stability of the resulting fluid composition is remarkably improved is brought about. The fluid composition according to the present invention is excellent in heat stability and durability and is hence suitable for a viscous fluid used in fluid couplings such as viscous couplings.

EMBODIMENTS OF THE INVENTION

The present invention will hereinafter be described by reference to the following examples and comparative examples. However, it should be borne in mind that the present invention is not limited to these examples only.

Examples 1–5, and Comparative Example 1:

A 2,5-dimercapto-1,3,4-thiadiazole derivative ("Cuvan 826", product of R. T. Vanderbilt Company, Inc.) was added in their corresponding proportions shown in Table 1 to dimethyl silicone oil (viscosity: 5,000 $mm^2$/sec at 25° C.) to prepare fluid compositions for viscous couplings. In Examples 2–4, diphenylamine was further added in a proportion of 1.0 wt. %. In Example 5, triphenyl phosphorothionate was further added in a proportion of 0.3 wt. %. For the sake of comparison, a fluid composition in which diphenylamine alone was added without adding the thiadiazole derivative was prepared (Comparative Example 1).

The thus-obtained fluid compositions were separately filled at 25° C. and a filling rate of 85 vol. % in a viscous coupling having 100 disks in total.

The viscous coupling was held in a constant temperature bath of 180° C. to run it for 50 hours under condition of a difference in number of revolutions of 50 rpm.

When the operating time elapsed, changes in viscosity and torque were determined. The results are shown in Table 1.

TABLE 1

| | Example | | | | | Comp. Ex. |
|---|---|---|---|---|---|---|
| | 1 | 2 | 3 | 4 | 5 | 1 |
| Dimethyl silicone oil ($mm^2$/sec) | 5,000 | 5,000 | 5,000 | 5,000 | 5,000 | 5,000 |
| 2,5-Dimercapto-*1 derivative (wt. %) 1,3,4-thiadiazole derivative (wt. %) | 0.5 | 0.1 | 0.5 | 1.5 | 0.5 | — |
| Diphenylamine (wt. %) | — | 1.0 | 1.0 | 1.0 | — | 1.0 |
| Oil temperature 180° C./50 hr: | | | | | | |
| Viscosity change (%) | +8.0 | +7.0 | +5.0 | +3.0 | +2.0 | Stop*2 |
| Torque change (%) | +7.0 | +6.0 | +4.0 | +4.0 | +4.0 | Stop*2 |

*1: "Cuvan 826", product of R. T. Vanderbilt Company, Inc.

*2: The evaluation was stopped because torque rapidly rose before completion of the 50-hour run.

As apparent from Table 1, it is understood that when the 2,5-dimercapto-1,3,4-thiadiazole derivative is added in a small amount to the dimethyl silicone oil, changes in viscosity and torque are suppressed under the high-temperate conditions (Examples 1–5). It is also understood that when diphenylamine or triphenyl phosphorothiohate is used in combination with the thiadiazole derivative, the viscosity stability and torque stability of the base oil are more improved (Examples 2–5).

Examples 6–10, and Comparative Examples 2–5:

Diphenylamine was added in a proportion of 0.1 wt. % to dimethyl silicone oil (viscosity: 8,000 $mm^2$/sec at 25° C.), and 2,5-dimercapto-1,3,4-thiadiazole derivative (Cuvan 826) was further added in a proportion shown in Table 2, thereby preparing fluid compositions for viscous couplings (Examples 6–10). In Examples 7–10, their corresponding various additives shown in Table 2 were further added. In Comparative Examples 2–5, only the additives other than the thiadiazole derivative were added to the dimethyl silicone oil as shown in Table 2.

The thus-obtained fluid compositions were separately filled at 25° C. and a filling rate of 85 vol. % in a viscous coupling having 100 disks in total.

The viscous coupling was held in a constant temperature bath of 130° C. to run it for 500 hours under condition of a difference in number of revolutions of 30 rpm. Similarly, the viscous coupling was held in a constant temperature bath of 150° C. to run it for 500 hours under conditions of an oil temperature of 150° C. and a difference in number of revolutions of 30 rpm.

When the operating time elapsed, changes in viscosity and torque were determined. The results are shown in Table 1.

As apparent from Table 2, it is understood that when diphenylamine, triphenyl phosphorothionate, tricresyl phosphate, methylenebis (dibutyldithiocarbamate) and/or the thiophosphoric compound is used in combination with the thiadiazole derivative, the viscosity stability and torque stability of the base oil are more improved (Examples 6–10). In particular, the addition of triphenyl phosphorothionate and methylenebis (dibutylthiocarbamate) brings about a marked effect on heat stability (Examples 7 and 9).

On the contrary, when the thiadiazole derivative is not added, the gelation of the base oil is allowed to progress to a great extent, thereby increasing its viscosity (Comparative Examples 2–4). Alternatively, reduction in viscosity occurs, so that the torque-transmitting ability of the base oil is deteriorated (Comparative Example 4).

Examples 11–13, and Comparative Examples 6 and 7:

Diphenyl amine was added in a proportion of 0.5 wt. % to dimethyl silicone oil (viscosity: 100,000 $mm^2$/sec at 25° C.), and a 2,5-dimercapto-1,3,4-thiadiazole derivative ("AMC 158", product of Amoco Chemicals Corporation) was further added in a proportion shown in Table 3 to prepare fluid compositions for viscous couplings (Examples 11–13). In Examples 12 and 13, their corresponding various additives shown in Table 3 were further added. In Comparative Examples 6 and 7, only the additives other than the thiadiazole derivative were added to the dimethyl silicone oil as shown in Table 3.

The thus-obtained fluid compositions were separately filled at 25° C. and a filling rate of 85 vol. % in a viscous coupling having 100 disks in total.

The viscous coupling was held in a constant temperature bath of 150° C. to run it for 200 hours under condition of a difference in number of revolutions of 30 rpm.

When the operating time elapsed, changes in viscosity and torque were determined. The results are shown in Table 3.

TABLE 2

| | Example | | | | | Comparative Example | | | |
|---|---|---|---|---|---|---|---|---|---|
| | 6 | 7 | 8 | 9 | 10 | 2 | 3 | 4 | 5 |
| Dimethyl silicone oil ($mm^2$/sec) | 8,000 | 8,000 | 8,000 | 8,000 | 8,000 | 8,000 | 8,000 | 8,000 | 8,000 |
| 2,5-Dimercapto-*1 1,3,4-thiadiazole derivative (wt. %) | 0.5 | 0.5 | 0.5 | 0.5 | 0.5 | — | — | — | — |
| Diphenylamine (wt. %) | 0.1 | 0.1 | 0.1 | 0.1 | 0.1 | 0.1 | 0.1 | 0.1 | 0.1 |
| Triphenyl phosphorothionate (wt. %) | — | 0.3 | — | — | — | 0.3 | — | — | — |
| Tricresyl phosphate (wt. %) | — | — | 0.3 | — | — | — | 0.3 | — | — |
| Methylenebis(dibutyldithiocarbamate (wt. %) | — | — | — | 0.3 | — | — | — | 0.3 | — |
| Thiophosphoric*2 compound (wt. %) | — | — | — | — | 0.3 | — | — | — | 0.3 |
| Oil temperature 130° C./500 hr: | | | | | | | | | |
| Viscosity change (%) | −4.0 | −2.0 | −2.0 | −1.5 | −2.0 | +13.0 | +7.0 | +8.0 | −12.0 |
| Torque change (%) | −5.0 | −3.0 | −3.0 | −2.0 | −3.0 | +12.0 | +6.0 | +6.0 | −13.0 |
| Oil temperature 150° C./500 hr: | | | | | | | | | |
| Viscosity change (%) | +5.0 | +2.0 | Stop*3 | −1.0 | −11.0 | +20.0 | Stop*3 | +16.0 | +20.0 |
| Torque change (%) | +10.0 | 0.0 | Stop*3 | +3.0 | −20.0 | +30.0 | Stop*3 | +20.0 | −22.0 |

Note:

*1: "Cuvan 826", product of R. T. Vanderbilt Company, Inc.

*2: "Irgalube 63", product of Chiba-Geigy AG.

*3: The evaluation was stopped because torque rapidly rose before completion of the 500-hour run.

TABLE 3

| | Example | | | Comp. Ex. | |
|---|---|---|---|---|---|
| | 11 | 12 | 13 | 6 | 7 |
| Diiaethyl silicone oil ($mm^2$/sec) | 100,000 | 100,000 | 100,000 | 100,000 | 100,000 |
| 2,5-Dimercapto-*1 1,3,4-thiadiazole derivative (wt.%) | 1.0 | 1.0 | 1.0 | — | — |
| Diphenylamine (wt. %) | 0.5 | 0.5 | 0.5 | 0.5 | 0.5 |
| Triphenyl phosphorothionate (wt. %) | — | 0.3 | — | 0.3 | — |
| Thiophosphoric*2 compound (wt. %) | — | — | 0.3 | — | 0.3 |
| Oil temperature 150° C./50 hr: | | | | | |
| Viscosity change (%) | −5.0 | −2.0 | −3.0 | +13.0 | −7.0 |
| Torque change (%) | −4.0 | −2.0 | −3.0 | +12.0 | −6.0 |

*1: "AMC 158", product of Amoco Chemicals Corporation.
*2: "Irgalube 63", product of Chiba-Geigy AG.

As apparent from Table 3, it is understood that in particular, the combined systems (Examples 12 and 13) of the thiadiazole derivative, diphenylamine and triphenyl phosphorothionate or the thiophosphoric compound are excellent in heat stability and markedly improved in viscosity stability and torque stability under high-temperature conditions. On the contrary, when the thiadiazole derivative is not added, viscosity increase of the base oil due to its gelation advances even when triphenyl phosphorothionate is added (Comparative Example 6). Alternatively, when the thiadiazole derivative is not added, reduction in viscosity occurs, so that the torque-transmitting ability of the base oil is deteriorated even when the thiophosphoric compound is added (Comparative Example 7).

Examples 14–16, and Comparative Examples 8 and 9:

Diphenyl amine was added in a proportion of 0.5 wt. % to dimethyl silicone oil (viscosity: 300,000 $mm^2$/sec at 25° C.), and a 2,5-dimercapto-1,3,4-thiadiazole derivative ("AMC 158", product of Amoco Chemicals Corporation) was further added in a proportion shown in Table 4 to prepare fluid compositions for viscous couplings (Examples 14–16). In Examples 15 and 16, their corresponding various additives shown in Table 4 were further added. In Comparative Examples 8 and 9, only the additives other than the thiadiazole derivative were added to the dimethyl silicone oil as shown in Table 4.

The thus-obtained fluid compositions were separately filled at 25° C. and a filling rate of 85 vol. % in a viscous coupling having 100 disks in total.

The viscous coupling was held in a constant temperature bath of 150° C. to run it for 300 hours under condition of a difference in number of revolutions of 30 rpm.

When the operating time elapsed, changes in viscosity and torque were determined. The results are shown in Table 4.

TABLE 4

| | Example | | | Comp. Ex. | |
|---|---|---|---|---|---|
| | 14 | 15 | 16 | 8 | 9 |
| Dimethyl silicone oil ($mm^2$/sec) | 300,000 | 300,000 | 300,000 | 300,000 | 300,000 |
| 2,5-Dimercapto-*1 1,3,4-thiadiazole derivative (wt. %) | 0.7 | 0.7 | 0.7 | — | — |
| Diphenylamine (wt. %) | 0.5 | 0.5 | 0.5 | 0.5 | 0.5 |
| Triphenyl phosphorothionate (wt. %) | — | 0.3 | — | 0.3 | — |
| Thiophosphoric*2 compound (wt. %) | — | — | 0.3 | — | 0.3 |
| Oil temperature 150° C./500 hr: | | | | | |
| Viscosity change (%) | −4.0 | −1.0 | −2.0 | +15.0 | −8.0 |
| Torque change (%) | −3.0 | −1.0 | −2.0 | +13.0 | −7.0 |

*1: "AMC 158", product of Amoco Chemicals Corporation.
*2: "Irgalube 63", product of Chiba-Geigy AG.

As apparent from Table 4, it is understood that in particular, the combined systems (Examples 15 and 16) of the thiadiazole derivative, diphenylamine and triphenyl phosphorothionate or the thiophosphoric compound are excellent in heat stability and markedly improved in viscosity stability and torque stability under high-temperature conditions. On the contrary, when the thiadiazole derivative is not added, viscosity increase of the base oil due to its gelation advances even when triphenyl phosphorothionate is added (Comparative Example 8). Alternatively, when the thiadiazole derivative is not added, reduction in viscosity occurs, so that the torque-transmitting ability of the base oil is deteriorated even when the thiophosphoric compound is added (Comparative Example 9).

Examples 17 and 18, and Comparative Examples 10 and 11:

A 2,5-dimercapto-1,3,4-thiadiazole derivative ("Cuvan 826", product of R. T. Vanderbilt Company, Inc.) was added in a proportion shown in Table 5 to dimethyl silicone oil (viscosity: 3,000 $mm^2$/sec at 25° C.) to prepare fluid compositions for viscous couplings (Examples 17 and 18). In Example 18, diphenylamine was further added in a proportion of 1.0 wt. %. In Comparative Example 10, the base oil alone was used. In Comparative Example 11, 0.5 wt. % of a 2,5-dimercapto-1,3,4-thiadiazole derivative (Cuvan 826) and 1.0 wt. % of diphenylamine were added to dimethyl silicone oil (viscosity: 1,000 $mm^2$/sec at 25° C.) to obtain a fluid composition.

The thus-obtained fluid compositions were separately filled at 25° C. and a filling rate of 85 vol. % in a viscous coupling having 100 disks in total.

The viscous coupling was held in a constant temperature bath of 180° C. to run it for 50 hours under condition of a difference in number of revolutions of 50 rpm.

When the operating time elapsed, changes in viscosity and torque were determined. The results are shown in Table 5.

TABLE 5

| | Example | | Comp. Ex. | |
|---|---|---|---|---|
| | 17 | 18 | 10 | 11 |
| Dimethyl silicone oil ($mm^2$/sec) | 3,000 | 3,000 | 3,000 | 1,000 |
| 2,5-Dimercapto-*1 1,3,4-thiadiazole | 0.5 | 0.5 | — | 0.5 |

TABLE 5-continued

| | Example | | Comp. Ex. | |
|---|---|---|---|---|
| | 17 | 18 | 10 | 11 |
| derivative (wt. %) | | | | |
| Diphenylamine (wt. %) | — | 1.0 | — | 1.0 |
| Oil temperature 180° C./50 hr: | | | | |
| Viscosity change (%) | +3.0 | +2.0 | Stop*2 | Stop*3 |
| Torque change (%) | 0.0 | +1.0 | Stop*2 | Stop*3 |

*1: "Cuvan 826", product of R. T. Vanderbilt Company, Inc.
*2: The evaluation was stopped because torque rapidly rose before completion of the 50-hour run.
*3: The evaluation was stopped because the absolute value of torque was lower by at least 40% than those of the fluid compositions according to Examples 17 and 18 after completion of the 50-hour run.

As apparent from Table 5, it is understood that the fluid compositions (Examples 17 and 18) according to the present invention exhibit good viscosity stability and torque stability. On the contrary, when the thiadiazole derivative is not added, rapid increase in torque, which is considered to be attributable to the progress of gelation, is observed (Comparative Example 10). Besides, even when the thiadiazole derivative is added, the absolute value of torque becomes too low when the viscosity of the base oil is too low, and so the resulting composition is unsuitable for a fluid composition for viscous couplings (Comparative Example 11).

Examples 19 and 20, and Comparative Examples 12 and 13:

A 2,5-dimercapto-1,3,4-thiadiazole derivative ("AMC 158", product of Amoco Chemicals Corporation) was added in their corresponding proportions shown in Table 6 to dimethyl silicone oil (viscosity: 100,000 $mm^2$/sec at 25° C.) to prepare fluid compositions for viscous couplings (Examples 19 and 20, and Comparative Example 12). In Example 19, a thiophosphoric compound ("Irgalube 63", product of Chiba-Geigy AG) was further added in a proportion of 0.3 wt. %. In Comparative Example 13, benzothiazole was added in a proportion of 0.5 wt. % instead of the thiadiazole derivative.

The thus-obtained fluid compositions were separately filled at 25° C. and a filling rate of 85 vol. % in a viscous coupling having 100 disks in total.

The viscous coupling was held in a constant temperature bath of 150° C. to run it for 200 hours under condition of a difference in number of revolutions of 30 rpm.

When the operating time elapsed, changes in viscosity and torque were determined. The results are shown in Table 6.

TABLE 6

| | Example | | Comp. Ex. | |
|---|---|---|---|---|
| | 19 | 20 | 12 | 13 |
| Dimethyl silicone oil ($mm^2$/sec) | 100,000 | 100,000 | 100,000 | 100,000 |
| 2,5-Dimercapto-*1 1,3,4-thiadiazole derivative (wt. %) | 0.5 | 3.0 | 5.0 | — |
| Thiophosphoric*2 compound (wt. %) | 0.3 | — | — | — |
| Benzothiazole (wt. %) | — | — | — | 0.5 |

TABLE 6-continued

| | Example | | Comp. Ex. | |
|---|---|---|---|---|
| | 19 | 20 | 12 | 13 |
| Oil temperature 150° C./50 hr: | | | | |
| Viscosity change (%) | −2.0 | −7.0 | −35 | Stop*3 |
| Torque change (%) | 0.0 | −6.0 | −30 | Stop*3 |

*1: "AMC 158", product of Amoco Chemicals Corporation.
*2: "Irgalube 63", product of Chiba-Geigy AG.
*3: The evaluation was stopped because torque rapidly rose before completion of the 200-hour run.

As apparent from Table 6, it is understood that as the proportion of the thiadiazole derivative incorporated is increased, the viscosity and torque of the fluid compositions become reduced (Examples 19 and 20, and Comparative Example 12). When the proportion exceeds the upper limit defined in the present invention, the viscosity is markedly reduced, and so the torque-transmitting ability of the composition is impaired (Comparative Example 12). Besides, in the fluid composition to which benzothiazole similar to the 5-membered heterocyclic compounds defined in the present invention was added, marked increase in viscosity and torque, which was considered to be attributable to the gelation of the base oil was observed, and such a composition was hence insufficient in heat stability (Comparative Example 13).

Examples 21 and 22, and Comparative Example 14:

A 2,5-dimercapto-1,3,4-thiadiazole derivative ("AMC 158", product of Amoco Chemicals Corporation) was added in a proportion shown in Table 7 to dimethyl silicone oil (viscosity: 500,000 $mm^2$/sec at 25° C.) to prepare fluid compositions for viscous couplings (Examples 21 and 22). In Example 22, a triphenyl phosphorothionate was further added. In Comparative Example 14, dimethyl silicone oil alone was evaluated.

The thus-obtained fluid compositions were separately filled at 25° C. and a filling rate of 85 vol. % in a viscous coupling having 100 disks in total.

The viscous coupling was held in a constant temperature bath of 180° C. to run it for 50 hours under condition of a difference in number of revolutions of 50 rpm.

When the operating time elapsed, changes in viscosity and torque were determined. The results are shown in Table 7.

TABLE 7

| | Example | | Comp. Ex. |
|---|---|---|---|
| | 21 | 22 | 14 |
| Dimethy silicone oil ($mm^2$/sec) | 500,000 | 500,000 | 500,000 |
| 2,5-Dimercapto-*1 1,3,4-thiadiazole derivative (wt. %) | 0.5 | 0.5 | — |
| Triphenyl phosphorothionate (wt. %) | — | 0.3 | — |
| Oil Temperature 180° C./50 hr: | | | |
| Viscosity change (%) | −3.0 | 0.0 | stop*2 |
| Torque change (%) | −4.0 | −2.0 | stop*2 |

*1: "AMC 158", product cf Amoco Chemicals Corporation.
*2: The evaluation was stoped because torque rapidly rose before completion of the 50-hour run.

As apparent from Table 7, it is understood that the fluid compositions according to the present invention have excellent viscosity stability and torque stability even when the viscosity of the base oil is as high as 500,000 $mm^2$/sec.

We claim:

1. A fluid composition for a fluid coupling, comprising (a) a polyorganosiloxane base oil having a viscosity of 3,000–500,000 $mm^2$/sec at 25° C., said polyorganosiloxane base oil being selected from the group consisting of dimethylsilicone oil, methylphenyl silicone oil, methyl hydrogensilicone oil and fluorosilicone oil, (b) at least one 5-membered heterocyclic compound incorporated in a proportion of 0.01–3.0 wt. % based on the total weight of the composition, said 5-membered heterocyclic compound being selected from the group consisting of 2,5-dimercapto-1,3,4-thiadiazole, 2-mercapto-5-methylmercapto-1,3,4-thiadiazole, di(5-mercapto-1,3,4-thiadiazole-2-yl)disulfide, 2-amino-5-mercapto-1,3,4-thiadiazole and derivatives of these compounds, and (c) at least one additive selected from the group consisting of an antioxidant and a wear preventive, wherein said antioxidant is incorporated in a proportion of 0.01–2.0 wt. % based on the total weight of the composition and said wear preventive is incorporated in a proportion of 0.01–5.0 wt. % based on the total weight of the composition.

2. The fluid composition according to claim 1, wherein a fluid coupling is a viscous coupling.

3. The fluid composition according to claim 1, wherein the antioxidant is an amine compound.

4. The fluid composition according to claim 1, wherein the wear preventive is a thiophosphoric ester, a bisphosphoric ester compound, bisthiophosphoric ester compound, bisdithiophosphoric ester compound, phosphorus compound or carbamate compound.

5. The fluid composition according to claim 1, wherein the wear preventive is a compound represented by the general formula (IX):

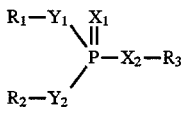

(IX)

In the general formula (IX), $R_1$ and $R_2$ are, independently of each other, a hydrogen atom or a monovalent hydrocarbon group having 1–20 carbon atoms, $R_3$ is a hydrocarbon group having 1–20 carbon atoms and at least one ester bond, $X_1$ and $X_2$, and $Y_1$ and $Y_2$ are, independently of each other, an oxygen or sulfur atom.

6. The fluid composition according to claim 5, wherein the compound represented by the general formula (IX) is a thiophosphoric ester compound.

7. The fluid composition according to claim 4, wherein phosphorus compound is a compound represented by the general formula (X), (XI), (XII) or (XIII):

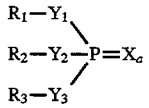

(X)

In the general formula (X), $R_1$–$R_3$ are, independently of each other, selected from a hydrogen atom and hydrocarbon groups having 1–20 carbon atoms, with the proviso that at least one of these is a hydrocarbon group, X, and $Y_1$–$Y_3$ are, independently of each other, an oxygen or sulfur atom, a is 0 or 1:

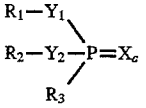

(XI)

In the general formula (XI), $R_1$–$R_3$ are, independently of each other, selected from a hydrogen atom and hydrocarbon groups having 1–20 carbon atoms, with the proviso that at least one of these is a hydrocarbon group, X, and $Y_1$ and $Y_2$ are, independently of each other, an oxygen or sulfur atom, a is 0 or 1:

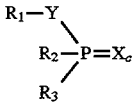

(XII)

In the general formula (XII), $R_1$–$R_3$ are, independently of each other, selected from a hydrogen atom and hydrocarbon groups having 1–20 carbon atoms, with the proviso that at least one of these is a hydrocarbon group, X and Y are, independently of each other, an oxygen or sulfur atom, a is 0 or 1:

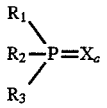

(XIII)

In the general formula (XIII), $R_1$–$R_3$ are, independently of each other, selected from a hydrogen atom and hydrocarbon groups having 1–20 carbon atoms, with the proviso that at least one of these is a hydrocarbon group, Halogenated groups thereof may also be included, X is an oxygen or sulfur atom, a is 0 or 1.

8. The fluid composition according to claim 7, wherein the phosphorus compound is a triaryl phosphate or triaryl phosphorothionate.

9. The fluid composition according to claim 4, wherein the carbamate compound is a dithiocarbamate compound represented by the general formula (XIV):

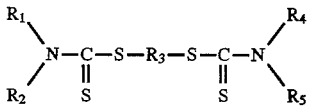

(XIV)

wherein $R_1$, $R_2$, $R_4$ and $R_5$ are, independently of each other, selected from a hydrogen atom and hydrocarbon groups having 1–20 carbon atoms, $R_3$ is a divalent hydrocarbon group, or a metal atom.

10. The fluid composition according to claim 1, comprising an amine compound as the antioxidant and a thiophosphoric ester compound as the wear preventive in proportions of 0.01–2.0 wt. % and 0.01–5.0 wt. %, respectively.

11. The fluid composition according to claim 1, comprising an amine compound as the antioxidant and a triaryl phosphorothionate as the wear preventive in proportions of 0.01–2.0 wt. % and 0.01–5.0 wt. %, respectively.

12. The fluid composition according to claim 1, comprising an amine compound as the antioxidant and a dithiocarbamate compound as the wear preventive in proportions of 0.01–2.0 wt. % and 0.01–5.0 wt. %, respectively.

* * * * *